US005993963A

United States Patent [19]

Teramoto et al.

[11] Patent Number: 5,993,963

[45] Date of Patent: Nov. 30, 1999

[54] POLYBENZAZOLE FIBER AND METHOD FOR PRODUCTION THEREOF

[75] Inventors: Yoshihiko Teramoto; Tooru Kitagawa; Yoshikazu Tanaka; Michio Ishitobi, all of Ohtsu, Japan

[73] Assignee: Toyo Boseki Kabushiki Kaisha, Japan

[21] Appl. No.: 08/940,780

[22] Filed: Sep. 30, 1997

[30] Foreign Application Priority Data

Oct. 1, 1996 [JP] Japan ..... 8-260895

[51] Int. Cl.[6] ..... D02G 3/00

[52] U.S. Cl. ..... 428/364; 428/394

[58] Field of Search ..... 428/357, 364, 428/394, 359

[56] References Cited

U.S. PATENT DOCUMENTS

| | | | |
|---|---|---|---|
| 4,847,350 | 7/1989 | Harris | 528/179 |
| 5,273,703 | 12/1993 | Alexander et al. . | |
| 5,288,452 | 2/1994 | Yabuki . | |
| 5,411,694 | 5/1995 | Alexander et al. . | |
| 5,429,787 | 7/1995 | Im et al. . | |
| 5,527,609 | 6/1996 | Yabuki et al. | 428/359 |
| 5,756,031 | 5/1998 | Tani | 264/203 |
| 5,772,942 | 6/1998 | Teramoto et al. | 264/233 |
| 5,780,152 | 7/1998 | Ichiryu et al. | 428/394 |

FOREIGN PATENT DOCUMENTS 0 472 834 3/1992 European Pat. Off. .

*Primary Examiner*—Newton Edwards
*Attorney, Agent, or Firm*—Morrison & Foerster

[57] ABSTRACT

A polybenzazole fiber characterized by having an elastic modulus of not less than 1350 g/d and requiring not longer than 10 minutes to reduce its water content from 2.0% to 1.5%, when determined using a thermogravimetric analyzer at 110° C. after moisture absorption of not less than 2.0% of a fiber, and a method for manufacturing such a polybenzazole fiber, comprising extruding a spinning dope comprising polybenzazole and a polyphosphoric acid from a spinneret to give a dope filament, and cooling the dope filament to not more than 50° C., followed by coagulation and washing. According to the method of the present invention, a polybenzazole fiber showing less decrease in strength by rapid heating can be provided.

6 Claims, 3 Drawing Sheets

POLYBENZAZOLE FIBER AND METHOD FOR PRODUCTION THEREOF

TECHNICAL FIELD OF THE INVENTION

The present invention relates to a polybenzazole fiber superior in heat resistance, flame retardance, strength and elastic modulus and which permits quick movement of material in the fiber, and to a method for production thereof. More particularly, the present invention relates to a polybenzazole fiber showing less decrease in strength even by rapid heating, which is attributable to quick release of water, and to a production method to form such fiber structure.

BACKGROUND OF THE INVENTION

A polybenzazole fiber has superior heat resistance and flame resistance, as well as sufficient strength and elastic modulus, so that it is expected to make a super fiber of the next generation. The process for manufacture of the polybenzazole fiber is described in, for example, Japanese Patent Application under PCT laid-open under Kohyo No. 500529/1988, wherein a dope containing a polyphosphoric acid solvent is cooled and solidified to give a dope filament, which is brought into contact with water or an aqueous solution of polyphosphoric acid contained in the dope to allow coagulation, and washed with water, followed by drying to afford a product. The polybenzazole fiber after drying is heat-treated to give a polybenzazole fiber having a high elastic modulus. When an industrial scale production of polybenzazole fiber is desired, a step of stretching a dope filament, a step of extracting a solvent from a dope filament, and a step of evaporating water from a fiber containing a large amount of water need to be finished in a short time. Japanese Patent Unexamined Publication Nos. 157918/1995 and 157919/1995 disclose spinning; and Japanese Patent Unexamined Publication No. 197307/1995 discloses a technique of drying to realize continuous production at a spinning rate of 200 m/min or above. Although the fibers manufactured by such steps have superior dynamic properties, such as strength and elastic modulus, as compared to fibers produced by spinning at a low rate of not more than 80 m/min and washing with water and drying under a low tension, the polymers constituting the former fibers become dense, which in turn slows down markedly the release of water contained inside. In addition, internal distortion tends to occur due to the surface tension of water filled in very narrow holes of about 20 Å within the fiber. A polybenzazole fiber having a high water content may have a decreased strength due to hydrolysis in the fiber when it is exposed to high temperature environment.

It is therefore an object of the present invention to provide a polybenzazole fiber having high strength and high elastic modulus, and which hardly suffers from occurrence of internal defect or hydrolysis, as a result of quick release of water during elevation of temperature for quick heating of the fiber.

SUMMARY OF THE INVENTION

A polybenzazole fiber has an equilibrium moisture regain of about 1.8% under the conditions of 20° C., 65% RH. A means has been found to prevent decrease in strength of such fiber in a high temperature environment. Accordingly, the present invention provides a polybenzazole fiber characterized by an elastic modulus of not less than 1350 g/d and the time necessary for reducing water content of the fiber from 2.0% to 1.5%, of not longer than 10 minutes, when the rate of loss in weight is determined by TGA (thermogravimetric analysis) at 110° C. after moisture absorption of not less than 2.0% of a fiber. The present invention also provides a method for manufacturing a polybenzazole fiber, comprising extruding a spinning dope comprising a polyphosphoric acid and a polybenzazole, cooling a dope filament obtained at a spinning rate of not less than 150 m/min, to not more than 50° C., and coagulating/washing same with water or a coagulation solution such as polyphosphoric acid; and a method for manufacturing a polybenzazole fiber, comprising extruding a spinning dope comprising a polyphosphoric acid and a polybenzazole to give a dope filament, cooling the dope filament obtained at a spinning rate of not less than 150 m/min, to not more than 50° C., coagulating same in an aqueous solution of polyphosphoric acid at 30–55° C. and washing same.

DETAILED DESCRIPTION OF THE INVENTION

Figure 1:
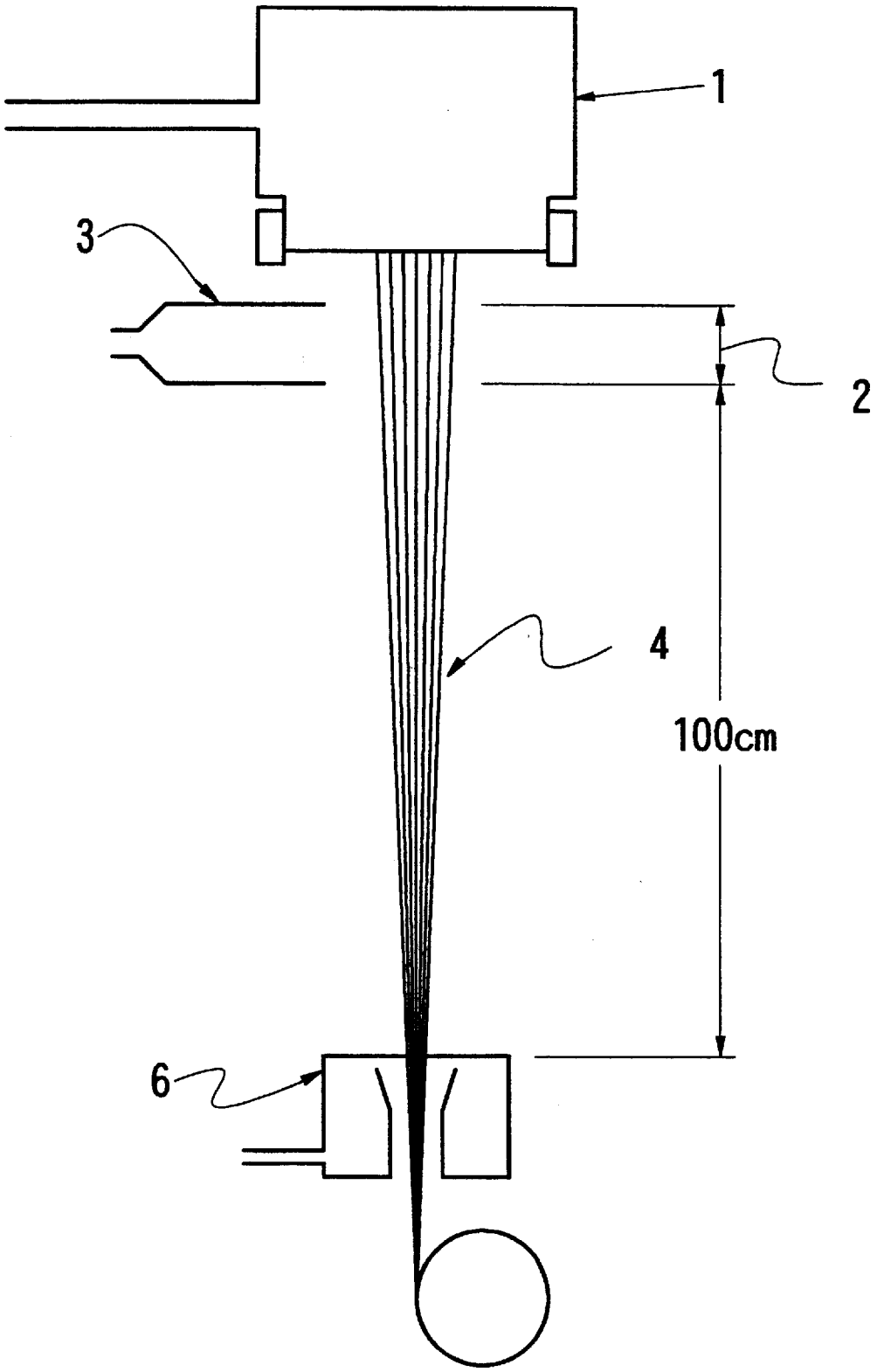
FIGS. 1 and 3 show an outline of production steps of the polybenzazole fiber of the present invention, wherein 1 is a spinneret, 2 is a draw zone, 3 is a quench air duct, 4 is a dope filament, 5 is an air-conditioning blow-off outlet, 6 is a coagulation bath, 7 shows a step for washing with water, 8 shows a drying step and 9 is a winding apparatus.

The polybenzazole fiber of the present invention refers to fibers made from a polybenzazole polymer. The polybenzazole (PBZ) includes polybenzoxazole (PBO) homopolymer, polybenzothiazole (PBT) homopolymer and POB and PBT random, sequential and block copolymers. As used herein, the polybenzoxazole, polybenzothiazole and random, sequential and block copolymers are disclosed in, for example, Wolfe et al., Liquid Crystalline Polymer Compositions, Process and Products, U.S. Pat. No. 4,703,103, Oct. 27, 1987; Liquid Crystalline Polymer Compositions, Process and Products, U.S. Pat. No. 4,533,692, Aug. 6, 1985; Liquid Crystalline Poly(2,6-Benzothiazole) Composition, Process and Products, U.S. Pat. No. 4,533,724, Aug. 6, 1985; and Liquid Crystalline Polymer Compositions, Process and Products, U.S. Pat. No. 4,533,693, Aug. 6, 1985; Evers, Thermooxidatively Stable Articulated p-Benzobisoxazole and p-Benzobisthiazole Polymers, U.S. Pat. No. 4,539,567, Nov. 16, 1982; Tasi et al., Method for Making Heterocyclic Block Copolymer U.S. Pat. No. 4,578,432, Mar. 25, 1986; and others.

The structural unit contained in the PBZ polymer is preferably selected from rheotropic liquid crystalline polymers. Said polymer comprises monomer units of the following formulas (a) to (h), more preferably monomer units selected from the following formulas (a) to (c):

(a)

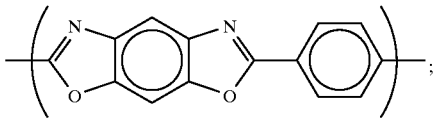

;

-continued (b)

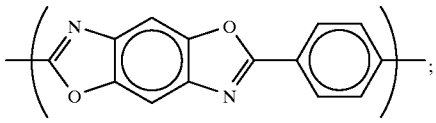

(c)

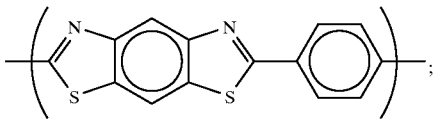

(d)

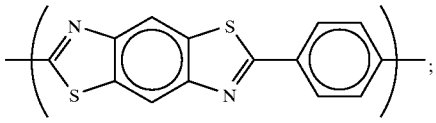

(e)

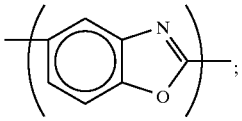

(f)

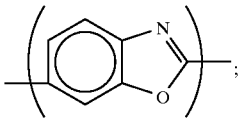

(g)

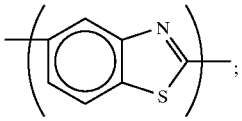

(h)

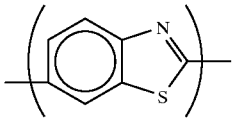

For manufacture of the polybenzazole fiber of the present invention, loss of strength was evaluated by treating a polybenzazole fiber in an oven at 350° C. for 2.5 hours, the fiber being adjusted to have an equilibrium moisture by storing, after winding around a 400 mm long stainless frame, at room temperature at 20° C., 65% RH for 48 hours or more. A comparison of a specimen having fine heat resistance as evidenced by its strength retention of not less than 60% and one showing a strength retention of less than 60% reveals variation in moisture loss rate with increasing temperatures of the sample. In other words, when the time necessary for diffusion of water molecule in the fiber and evaporation thereof from the fiber surface was shorter in the course of the temperature rise of the sample, a decrease in strength at high temperature could be prevented. It is postulated that this is attributable to the loss of water molecules from the polymer before it reaches a temperature at which hydrolysis of polybenzazole polymer becomes vigorous, so that a decrease in fiber strength due to the hydrolysis can be suppressed.

The diffusion rate of water in the polybenzazole fiber depends on the structure of the fiber. In particular, when the fiber has a higher average orientation degree and greater thickness of the skin layer or a denser skin layer, the diffusion rate of water in the fiber becomes lower. A sample having a high average orientation degree generally has a higher elastic modulus of the fiber. Among the steps for manufacture of polybenzazole fiber to be mentioned later, the step of drying non-solvents remaining in the fiber after washing away the solvent in the fiber can contribute most to the orientation of the fiber. As disclosed in Japanese Patent Unexamined Publication No. 209445/1996, application of a high tension in this step promotes orientation of the fiber and produces a fiber having a high elastic modulus. However, such fiber is associated with the defect that it has low diffusion rate of water as compared to a sample dried under a low tension of not more than 0.5 g/d, and tends to show less strength as mentioned above.

Water diffusion rate in the fiber is evaluated as follows. Water diffusion rate can be quantitatively evaluated based on weight increase by water adsorption of an absolute dry sample, weight decrease by drying a sample after sufficient adsorption of water and the like. A decrease in weight of a sample which absorbed water is measured by TGA here. To be specific, a polybenzazole fiber sample is immersed in water for 16 hours and hung in a room for one hour at 20° C. and 65% RH to dry the surface. Then, 10 mg of the sample is placed on an aluminum plate of TG-DTA 2000S manufactured by MAC-Science and the temperature thereof is elevated to 110° C. at an elevation rate of 300° C./min. The air flow rate is 100 cc/min of argon. The reason for setting the temperature to 110° C. is that an excessively high temperature prevents quantitative comparison, because the fiber is dried before the temperature elevation of apparatus is completed, whereas a temperature of not more than 100° C. requires very long time for drying. The water content is calculated in percentage relative to the weight of the polymer which is the weight measured when the polymer is retained for 2.5 hours at 110° C. and then elevated to a temperature of 200° C. at a rate of 350° C./min and retained for 30 minutes at said temperature.

A polybenzazole fiber having superior heat resistance, and which retains strength by not less than 60% after heat-dry treatment at 350° C. can be obtained by adjusting the time necessary for decreasing water content from 2.0% to 1.5%, to not more than 10 minutes, preferably not more than 8 minutes, more preferably not more than 6 minutes, when weight loss rate is determined using a TGA at 110° C.

In this way, a polybenzazole having a high diffusion rate of water in the fiber has been found to show less loss of strength by rapid heating. It has been also found that this diffusion rate becomes lower in a high quality fiber having high elastic modulus, which is produced by, for example, a method comprising successive coagulation step and spinning step, so that the fiber cannot satisfy the above requirements and the sufficient strength is lost by rapid heating. Conversely, a polybenzazole fiber having insufficient fiber molecular orientation during production and which fails to reach 1350 g/d of elastic modulus shows higher diffusion rate of water in the fiber and tends not to lose strength by rapid heating. Thus, the present invention provides a polybenzazole fiber having high quality, and high impact resistance at high temperature, which has an elastic modulus of not less than 1350 g/d but is less affected by loss of strength by rapid heating. The process thereof is explained in the following.

A suitable solvent for preparing a dope of PBZ polymer is exemplified by cresol and non-oxidative acid capable of dissolving the PBZ polymer. Examples of suitable acid solvent include polyphosphoric acid, methanesulfonic acid, high conc. sulfuric acid, and mixtures thereof. More preferred are polyphosphoric acid and methanesulfonic acid, and most preferred is polyphosphoric acid.

The polymer concentration in the dope is at least about 7% by weight, more preferably at least 10% by weight, and most preferably at least 13% by weight. The maximum concentration thereof is limited by actual handling property such as solubility of polymer and viscosity of the dope. Due to such limiting factors, the polymer concentration of the dope does not generally exceed 20% by weight.

A suitable polymer, copolymer and dope are synthesized by a known method. For example, the methods described in Wolfe et al., U.S. Pat. No. 4,533,693 (Aug. 6, 1985), Sybert et al., U.S. Pat. No. 4,772,678 (Sep. 20, 1988), Harris, U.S. Pat. No. 4,847,350 (Jul. 11, 1989), and others are used. According to Gregory et al., U.S. Pat. No. 5,089,591 (Feb. 18, 1992), PBZ polymer can be made to have a high molecular weight at a high reaction rate under the conditions of comparatively high temperature and high shear in a dehydrative acid solvent.

The dope containing a (co)polymer thus polymerized is fed into a spinning part and industrially processed via successive steps of high speed spinning at a rate of not less than 150 m/min, washing with water and drying. When the spinning rate does not reach 150 m/min, productivity becomes low and the dope is thus unsuitable for industrial production. A higher spinning rate is more preferable from the aspect of productivity, and yet more preferable spinning rate is not less than 300 m/min which is most preferably not less than 600 m/min. When the rate is more than 2500 m/min, problems in production may be encountered, such as excessively large pressure when extruding the dope from spinneret and difficult exchange of cheeses in a winder.

The dope is generally delivered from the spinneret at a temperature of not less than 100° C. The spinnerets generally contain small holes arranged in plurality to form a circle, lattice or other shape. The number of small holes of spinerret is not particularly limited, but the array thereof on the surface of the spinneret needs to have certain hole density so that adhesion of delivered filaments would not occur. In case of high speed spinning, moreover, an array of holes and cooling air stream should be controlled so that the temperature of cooling air between filaments would be optimized. The dope filaments discharged from the spinneret into non-coagulating air (i.e., air gap) is given draft in the air gap. It is particularly effective to set a so-called quench chamber to cool the filaments using a cooling wind in the air gap for stable production at high spinning speed. The preferable temperature of the cooling air is not less than about 10° C. and not more than 120° C., which varies depending on molecular weight of the polymer, polymer concentration of the dope and the like. The dope filament solidified by cooling is adjusted, prior to initiation of coagulation, to have a suitable temperature for forming a fiber structure capable of achieving the object of the present invention in the next coagulation step. That is, the temperature of the dope filament, when coagulation solution comes into contact with dope filament, is adjusted to be not more than 50° C. When the temperature of the dope filament is higher than 50° C., the fiber structure varies from the structure of a fiber produced from a dope filament having a temperature of not more than 50° C., and diffusion of water slows when the fiber after drying has a high orientation degree. What causes this phenomenon is not certain, but the following is speculated. That is, when a tension, which is caused by friction between coagulation solution and the filament, is added to a spinning tension, the filament is elongated due to modification of plasticity. Along with this small elongation begins coagulation near the surface of the fiber, and for a certain time, coagulation proceeds while the stress concentrates on the surface of the fiber, which causes denser structure of the fiber surface. Then, the occasional presence of such dense structure on the fiber surface causes a delay of diffusion of water. The temperature of dope filament at the initiation of coagulation is considered to be dependent on the conditions of coagulation solution. That is, when a coagulation solution showing high coagulation performance (for instance, low concentration of an aqueous polyphosphoric acid solution or high temperature) is used, a fiber structure permitting quick diffusion of water is obtained even at a comparatively high dope filament temperature. However, the dope filament needs to be cooled to not more than 50° C. More preferable temperature of dope filament immediately before coagulation is not more than 45° C., and most preferably not more than 40° C. Note that there is not much difference in effects between 20° C. and temperatures lower than 20° C. The temperature of the dope filament is lowered by installing a cooling zone beneath the draw zone to blow cool wind against dope filament, bringing the dope filament into contact with cooling roll and other methods. A method aiming at heat exchange with ambient air during a long distance taken between solidification point and coagulation bath is simple and easy. The distance between cool-solidification point and coagulation bath depends on ambient temperature and spinning speed. It is preferably not less than 40 cm when the spinning speed is 200 m/min, not less than 70 cm when the spinning speed is 400 m/min, and not less than 90 cm when the spinning speed is 600 m/min.

The dope filament is led to a coagulation bath, which is followed by coagulation and/or extraction. The coagulation solution is preferably an aqueous solution of polyphosphoric acid from practical aspect, which is a dope solvent. The concentration of the polyphosphoric acid solution is preferably not less than 2 wt % so as to reduce the amount of water necessary for the step and to reduce the cost for the recovery of the solvent. When the concentration of polyphosphoric acid exceeds 50 wt %, coagulation performance becomes insufficient, which in turn makes handling after coagulation bath difficult. The most preferable concentration of polyphosphoric acid in the aqueous solution is not less than 15 wt % and not more than 35 wt %. In generality, the coagulation step is set to be performed right beneath the air gap and the fiber structure is formed while removing the solvent from the fiber filaments under the spinning tension and the tension applied by the friction between coagulation solution and the filaments. For quick water diffusion of the dried polybenzazole fiber having a high elastic modulus, the temperature of the coagulation solution needs to be not less than 30° C. In the range of up to 90° C. where the diffusion was examined, a higher temperature of the coagulation solution was associated with quicker diffusion of water, whereas a temperature of the coagulation solution exceeding 55° C. resulted in reduction of strength. Even if water is diffused quickly and reduction of strength at high temperature is suppressed, the effect of invention cannot be exerted practically when the fiber has low strength. The most preferable temperature of the coagulation solution is not less than 45° C. and not more than 55° C.

Subsequent to coagulation, the solvent is extracted by washing to make the concentration of the solvent not more than about 1.5% of the weight of the polymer. For efficient extraction, the concentration of the solution in the fiber should be kept low. Thus, a process wherein the solution is renewed by hitting the fiber with a jet of water for washing is preferable. In this step, a single yarn is applied with not less than about 0.5 kg of tension so as to allow each fiber to run without being tangled.

A neutralization step or dipping into a light resistant agent may be applied after or during solvent extraction.

After sufficient extraction of the solvent, the fiber is led to a heating zone, without once winding, to dry the fiber. It is a general practice to apply a tension of not less than about 0.3 kg per a single yarn so as to prevent filament opening by static electrification. A water content not affecting subsequent processing is achieved in this drying step. When winding into a cheese, the fiber needs to be dried to a water content near equilibrium moisture so as to prevent collapse of winding during storage.

The polybenzazole fiber thus produced is characterized by a higher elastic modulus as compared to a fiber which underwent washing with water and drying without tension. For example, the elastic modulus of a fiber is about 1050–1150 g/d, which underwent coagulation, washing with water and winding into a cheese at a rate of 60 m/min, and then washing the cheese with water and drying of the same. That when the fiber underwent on-line washing with water and drying of the same at a spinning rate of 150 m/min is about 1100–1250 g/d. By increasing the tension applied during winding of the fiber around a bobbin, a polybenzazole fiber having an elastic modulus of not less than 1350 g/d can be produced. On the other hand, when the steps of from spinning to drying are completed on-line, the elastic modulus is about 1300 to 1750 g/d. The elastic modulus of polybenzazole fiber becomes higher with a higher degree of molecular orientation. It is considered that molecular orientation easily proceeds in on-line production, since the structure is formed under tension. Since it is preferable to make the molecular orientation higher during drying to achieve an elastic modulus of not less than 1350 g/d, the tension during drying is preferably set to not less than 0.6 g/d, more preferably not less than 0.8 g/d. The elastic modulus of the polybenzazole fiber of the present invention is preferably not less than 1400 g/d, more preferably not less than 1500 g/d, especially not less than 1600 g/d.

The polybenzazole fiber of the present invention can be used for various applications. For example, it can be used widely to produce, for example, tension members such as rope, gut and fishline, impact resistant members, heat resistant and flame resistant members such as fireproof and waterproof garment, heat resistant felt, heat resistant woven fabric and heat resistant cushion, and other products.

The present invention is described in more detail by way of Examples, to which the present invention is not limited.

Determination of Strength, Elastic Modulus and Elongation

A 50 kg chuck for tire cord was set on a tensilon universal testing machine manufactured by Orientec, and strength and elastic modulus of a fiber to be tested were determined at twist factor of 6 as defined by the following formula. The tensile conditions were yarn length 200 mm and cross head rate 200 mm/min.

$$\text{Twist factor}=0.131\times(\text{number of twist per inch})\times(\text{denier})^{0.5}$$

Determination by TGA

TGA using a thermobalance was performed using TG-DTA2000S manufactured by MAC-Science. A polybenzazole sample was immersed in water for 16 hours and hung in a room for one hour at 20° C. and 65% RH to remove water from the fiber surface. Then, 10 mg of the sample was placed on an aluminum plate of TG-DTA 2000S manufactured by MAC-Science and the temperature thereof was elevated to 110° C. at an elevation rate of 300° C./min. The air flow rate was 100 cc/min argon gas. The reason for setting the temperature to 110° C. was that a high temperature prevents quantitative comparison because the fiber is dried before temperature elevation of the apparatus, and a temperature of not more than 100° C. requires very long time for drying. The water content was calculated in percentage relative to the weight of the polymer which was the weight when the polymer was retained for 2.5 hours at 110° C. and then elevated to a temperature of 200° C. and retained for 30 minutes at said temperature.

Figure 2:
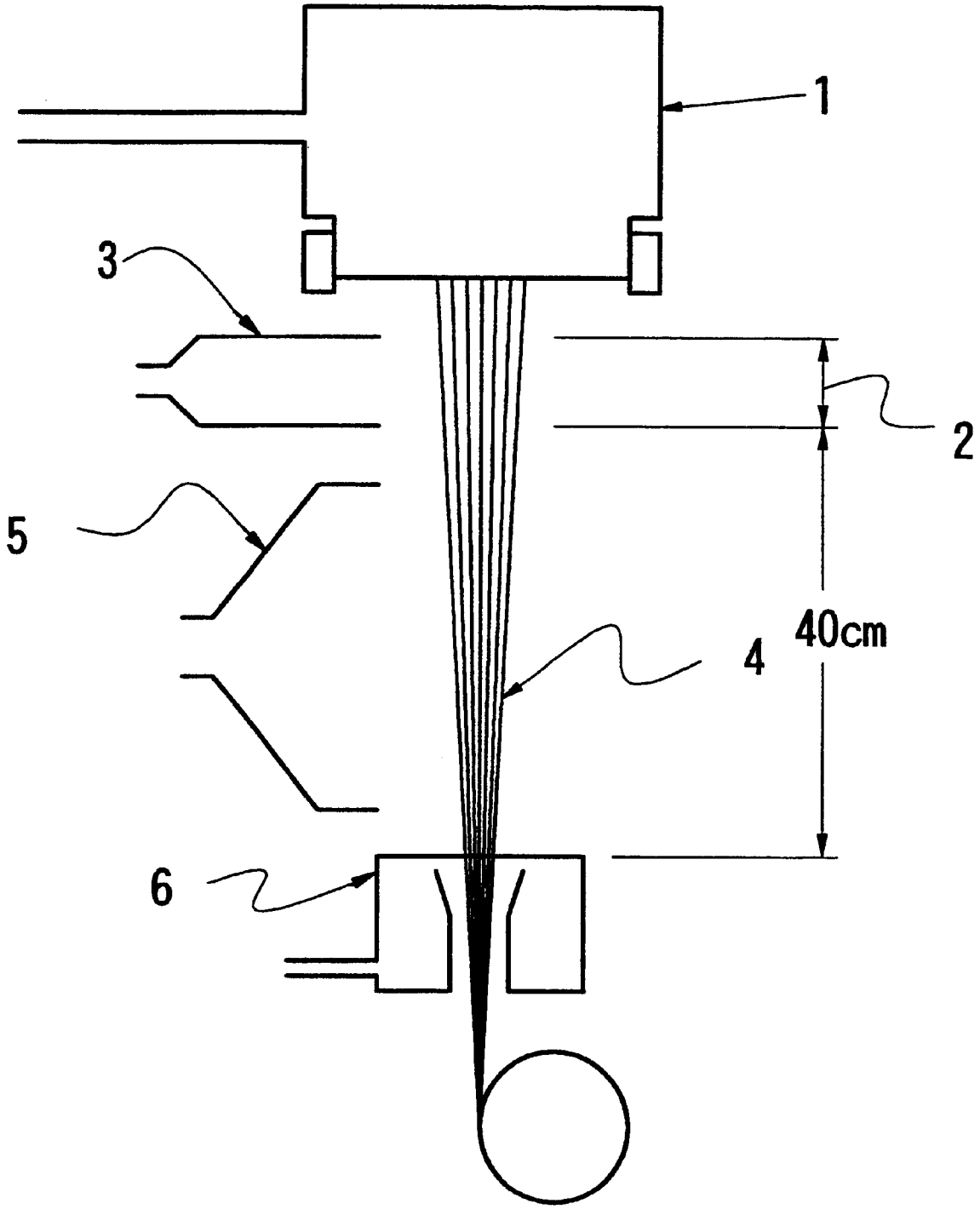
FIG. 2 shows curves of weight loss by drying, as measured by TGA, wherein A is a weight loss curve obtained in Example 3, B is a weight loss curve obtained in Example 5, C is a weight loss curve obtained in Comparative Example 1, and D is a weight loss curve obtained in Example 1.
Figure 3:
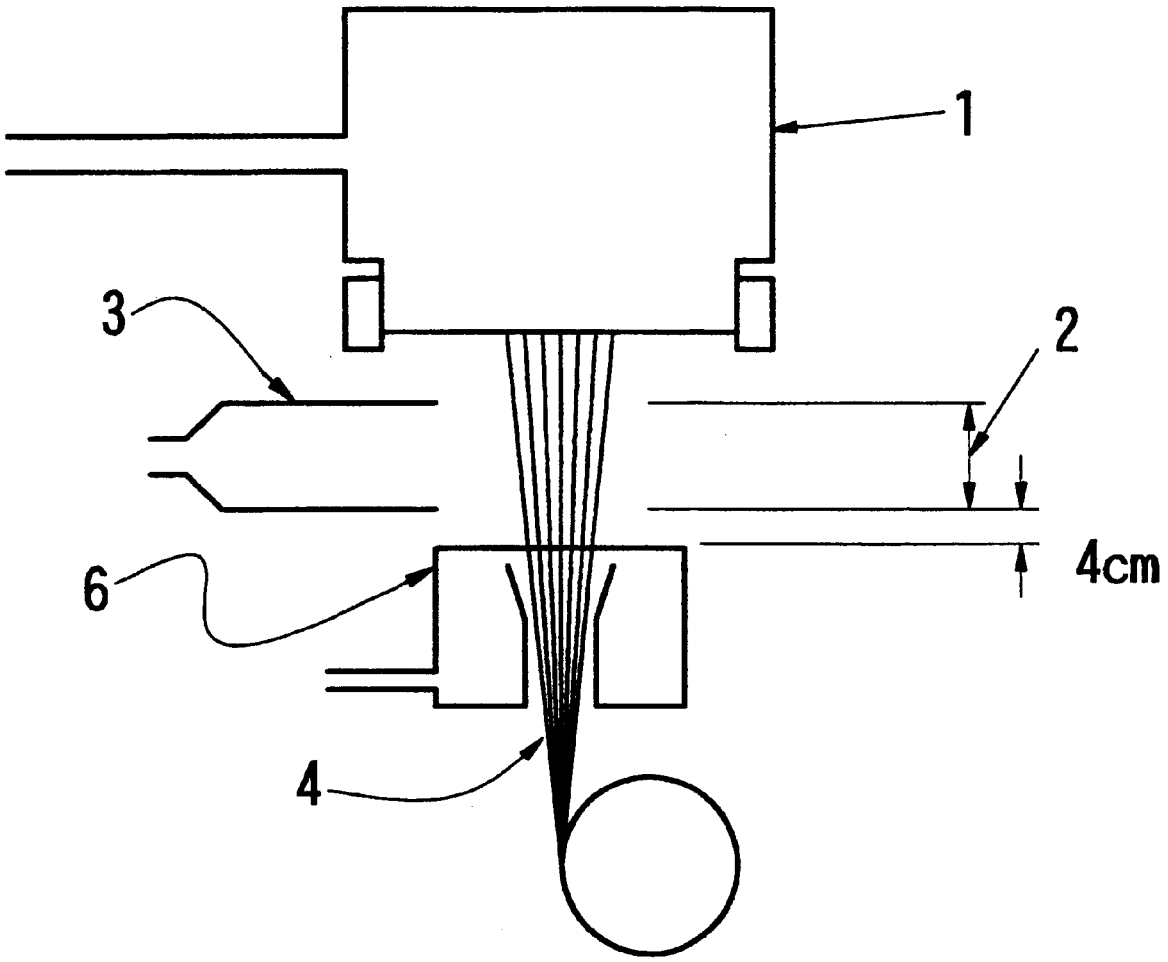

The time and water content were plotted as in FIG. 2, from which the time when the water content reduced from 2.0% to 1.5% was calculated and taken as a weight loss rate.

Measurement of Temperature of Dope Filament Before Coagulation

A close-up lens having a spot size of 100 micron (focus distance 6 inches) was set on an infrared thermometer model 760 manufactured by Inframeritics, and the temperature of filament at the site of coagulation bath was measured. The injection rate of the dope filament was 0.79.

EXAMPLES 1–5, COMPARATIVE EXAMPLE 1

A spinning dope was spun, which was made from polybenzoxazole (14.0 wt %) having an intrinsic viscosity of 26.4 dL/g as measured in a methanesulfonic acid solution at 30° C. and polyphosphoric acid containing phosphorus pentaoxide in a proportion of 83.17 wt %, which was obtained according to the method disclosed in U.S. Pat. No. 4,533,693. The dope was passed through a metal mesh filter and kneaded and defoamed in a biaxial kneader. The pressure was raised, the dope temperature was kept at 178° C., and the dope was spun out from a spinneret having 334 holes at 176° C. The delivered filaments were cooled with cooling wind at 70° C. or 75° C. and led into a coagulation bath filled with 22% aqueous solution of polyphosphoric acid adjusted to 50° C. The conditions such as spinning rate and temperature of dope filament before coagulation were as recited in Table 1. In Example 1, a tension of 2 g/d was applied to the filament after coagulation and washing with water, and the filament was washed with water for 16 hours on a winding-up bobbin, which was followed by immersion in 0.1N sodium hydroxide solution for 10 minutes and washing with water for 2 hours. The filaments were placed in a dryer at 80° C. and dried for 16 hours. In other Examples, spinning, coagulation, washing with water for neutralization and drying were performed on-line. The dryer was a hot air drying type oven (wind rate 16 m/sec). The conditions for washing with water and drying, as well as properties of the fiber obtained are shown in Table 1.

TABLE 1

| | Ex. 1 | Comp. Ex. 1 | Ex. 2 | Ex. 3 | Ex. 4 | Ex. 5 |
|---|---|---|---|---|---|---|
| spinning rate (m/min) | 150 | 600 | 600 | 600 | 600 | 800 |
| quench temperature (° C.) | 70 | 75 | 75 | 75 | 75 | 75 |
| quench air rate (m/sec) | 0.4 | 0.5 | 0.5 | 0.5 | 0.5 | 0.5 |
| quench-coagulation bath atmosphere temp. (° C.) | 32 | 35 | 35 | 22 | 35 | 29 |
| quench-coagulation bath distance (m) | 40 | 40 | 100 | 40 | 100 | 120 |
| dope filament temperature (° C.) before coagulation | 35 | 65 | 48 | 45 | 40 | 43 |
| residence time in coagulation solution (sec) | 0.3 | 0.07 | 0.07 | 0.07 | 0.07 | 0.05 |
| washing with water | on line | on line | on line | on line | on line | on line |

TABLE 1-continued

| | Ex. 1 | Comp. Ex. 1 | Ex. 2 | Ex. 3 | Ex. 4 | Ex. 5 |
|---|---|---|---|---|---|---|
| drying step | bobbin dry | on line | on line | on line | on line | on line |
| tension during drying (g/d) | — | 0.9 | 0.9 | 0.9 | 0.9 | 1.0 |
| drying temperature (° C.) | 80 | 250 | 250 | 250 | 250 | 250 |
| equilibrium moisture regain (%) | 2.1 | 1.7 | 1.8 | 1.8 | 1.8 | 1.7 |
| denier (den) | 498 | 499 | 497 | 498 | 501 | 495 |
| strength (g/d) | 43 | 46 | 44 | 45 | 45 | 47 |
| elongation (%) | 4.1 | 3.9 | 3.7 | 3.8 | 3.8 | 3.7 |
| elastic modulus (g/d) | 1350 | 1530 | 1490 | 1510 | 1530 | 1670 |
| drying time (min) | 5 | 20 | 7 | 5 | 5 | 8 |
| pattern in FIG. 2 | D | A | | C | | B |

As is evident from Table 1, adjustment of temperature of the dope filament entering the coagulation solution enabled control of fiber structure to allow quick diffusion of water.

The sample bobbins from Examples 1–5 and Comparative Example 1 were stored for 48 hours or more in a dark box at 20° C., 65% RH, and adjusted to equilibrium moisture. The fibers were wound around a 400 mm long stainless frame and kept in an oven at 350° C. for 2.5 hours for evaluation of loss of strength. The strength, elongation and elastic modulus after high temperature treatment and retention of strength are shown in Table 2.

TABLE 2

| | Ex. 1 | Comp. Ex. 1 | Ex. 2 | Ex. 3 | Ex. 4 | Ex. 5 |
|---|---|---|---|---|---|---|
| strength (g/d) | 28 | 24 | 28 | 30 | 29 | 29 |
| elongation (%) | 2.7 | 1.9 | 2.3 | 2.5 | 2.4 | 2.3 |
| elastic modulus (g/d) | 1370 | 1560 | 1510 | 1520 | 1550 | 1680 |
| retention of strength (%) | 66 | 52 | 63 | 66 | 65 | 62 |

The inventive fiber, which allows quick diffusion of water, showed 60% or more retention of strength after high temperature treatment at 350° C., thus showing high heat resistance.

EXAMPLES 6–10, COMPARATIVE EXAMPLE 2

Under the same spinning conditions as in Example 2 and at a spinning rate of 600 m/min, samples were prepared by changing the temperature of coagulation solution containing 22% polyphosphoric acid from 25° C. to 80° C. The strength, elastic modulus and time necessary for drying to make water content from 2.0% to 1.5% by TGA are shown in Table 3.

TABLE 3

| | Comp. Ex. 2 | Ex. 6 | Ex. 2 | Ex. 7 | Ex. 8 | Ex. 9 |
|---|---|---|---|---|---|---|
| spinning rate (m/min) | 600 | 600 | 600 | 600 | 600 | 800 |
| quench temperature (° C.) | 75 | 75 | 75 | 75 | 75 | 75 |
| quench air rate (m/sec) | 0.5 | 0.5 | 0.5 | 0.5 | 0.5 | 0.5 |
| quench-coaguiation bath atmosphere temp. (° C.) | 35 | 35 | 35 | 35 | 35 | 35 |
| quench-coagulation bath distance (m) | 100 | 100 | 100 | 100 | 100 | 100 |
| dope filament temperature (° C.) before coagulation | 55 | 48 | 48 | 48 | 48 | 48 |
| temperature of coagulation solution (° C.) | 25 | 30 | 50 | 55 | 60 | 80 |
| residence time in coagulation solution (sec) | 0.07 | 0.07 | 0.07 | 0.07 | 0.07 | 0.07 |
| washing with water | on line | on line | on line | on line | on iine | on line |
| drying step | on line | on line | on line | on line | on line | on line |
| tension during drying (g/d) | 0.9 | 0.9 | 0.9 | 0.9 | 0.9 | 0.9 |
| drying temperature (° C.) | 250 | 250 | 250 | 250 | 250 | 250 |
| denier (den) | 498 | 496 | 497 | 498 | 497 | 498 |
| strength (g/d) | 44 | 46 | 44 | 45 | 41 | 39 |
| elongation (%) | 3.6 | 3.9 | 3.7 | 3.8 | 3.6 | 3.5 |
| elastic modulus (g/d) | 1520 | 1530 | 1490 | 1510 | 1500 | 1530 |
| drying time (min) | 12 | 10 | 7 | 6 | 6 | 7 |

A low temperature of coagulation solution sometimes resulted in failure to work the invention (Comparative Example 2). When the temperature of coagulation solution exceeded 55° C., the strength of polybenzazole fiber decreased.

According to the present invention, production of polybenzazole fiber superior in heat resistance can be made possible.

This application is based on application Ser. No. 260895/1996 filed in Japan, the content of which is incorporated hereinto by reference.

What is claimed is:

1. A polybenzazole fiber characterized by having an elastic modulus of not less than 1350 g/d and requiring not longer than 10 minutes to reduce its water content from 2.0% to 1.5%, when the rate of loss in weight is determined using a thermogravimetric analyzer at 110° C. after moisture absorption of not less than 2.0% of a fiber.

2. The polybenzazole fiber according to claim 1, wherein the elastic modulus is not less than 1400 g/d.

3. The polybenzazole fiber according to claim 1, wherein the elastic modulus is not less than 1500 g/d.

4. The polybenzazole fiber according to claim 1, wherein the elastic modulus is not less than 1600 g/d.

5. The polybenzazole fiber according to claim 1, wherein the fiber requires not longer than 8 minutes to reduce its water content from 2.0% to 1.5%.

6. The polybenzazole fiber according to claim 1, wherein the fiber requires not longer than 6 minutes to reduce its water content from 2.0% to 1.5%.

* * * * *